US006997816B2

(12) United States Patent
Gager

(10) Patent No.: US 6,997,816 B2
(45) Date of Patent: Feb. 14, 2006

(54) MECHANICAL HANDLING DEVICE FOR GOLF BALLS AT A DRIVING RANGE

(75) Inventor: Philip Gager, Sheffield (GB)

(73) Assignee: All Year Ventures LTD, (GB)

( * ) Notice: Subject to any disclaimer, the term of this patent is extended or adjusted under 35 U.S.C. 154(b) by 0 days.

(21) Appl. No.: 10/470,297

(22) PCT Filed: Feb. 22, 2002

(86) PCT No.: PCT/GB02/00788

§ 371 (c)(1),
(2), (4) Date: Dec. 22, 2003

(87) PCT Pub. No.: WO03/004110

PCT Pub. Date: Jan. 16, 2003

(65) Prior Publication Data

US 2004/0082398 A1 Apr. 29, 2004

(30) Foreign Application Priority Data

Jul. 3, 2001 (GB) ..... 0116204

(51) Int. Cl.
*A63B 57/00* (2006.01)

(52) U.S. Cl. ..... 473/137; 473/134

(58) Field of Classification Search ..... 473/132–137
See application file for complete search history.

(56) References Cited

U.S. PATENT DOCUMENTS

| | | | | |
|---|---|---|---|---|
| 1,850,174 A | | 3/1932 | Joseph | |
| 1,937,180 A | * | 11/1933 | Young | 473/137 |
| 2,127,282 A | | 8/1938 | Beckett | |
| 2,216,853 A | | 10/1940 | Middleton | |
| 2,295,599 A | * | 9/1942 | Mozel | 473/136 |
| 2,789,824 A | * | 4/1957 | Wilcox | 473/136 |
| 3,142,488 A | | 7/1964 | Portteus | |
| 3,147,980 A | * | 9/1964 | Gollahon | 473/134 |
| 3,901,515 A | | 8/1975 | Mozel | |
| 4,017,087 A | * | 4/1977 | Bruno | 473/133 |
| 4,817,955 A | * | 4/1989 | Hickson et al. | 473/136 |
| 5,259,622 A | | 11/1993 | Irving | |
| 5,674,130 A | * | 10/1997 | Egan | 473/132 |

* cited by examiner

*Primary Examiner*—Steven Wong
(74) *Attorney, Agent, or Firm*—Bachman & LaPointe, P.C.

(57) ABSTRACT

A mechanical handling device for golf balls at a driving range, comprising a pivotally mounted balance or lever arm provided at one end with a tee adapted, in use, to receive and support a golf ball from a supply source, and provided at its other end with a weight sensitive transducer whereby, from a neutral start position, the arm/tee is initially pivoted downwardly under the influence of the weight of a ball arriving at the tee, such initial movement being sensed by the transducer to activate control means causing the arm/tee to be pivoted to an elevated, striking position, and loss of ball weight at the tee, after striking of the ball, also being sensed by the transducer to activate control means to cause the arm/tee to be pivotally returned to its neutral position. The invention also includes a driving range tee provided with a device.

22 Claims, 9 Drawing Sheets

MECHANICAL HANDLING DEVICE FOR GOLF BALLS AT A DRIVING RANGE

FIELD OF THE INVENTION

This invention relates to a mechanical handling device for golf balls and in particular, to a device for the placing of a golf ball on a tee at a driving range.

BACKGROUND OF THE INVENTION

Various devices have been proposed for the removal of an individual golf ball from a reservoir of golf balls and the transportation of individual balls to a tee, c.f. U.S. Pat. No. 4,796,893 and U.S. Pat. No. 5,259,622, most of which devices have required activation by the golfer. In other more rudimentary systems, the golfer brings a basket of balls and places them individually on the tee. All such proposals have required movement of the golfer from the position and stance adopted for the previous ball, which unavoidable movement is not always desirable or beneficial if the golfer is seeking to improve a golf swing etc.

OBJECT OF THE INVENTION

A basic object of the invention is the provision of an improved mechanical handling device for golf balls at a driving range.

SUMMARY OF A FIRST ASPECT OF THE INVENTION

According to a first aspect of the invention there is provided a mechanical handling device for golf balls at a driving range, comprising a pivotally mounted balance or lever arm provided at one end with a tee adapted, in use, to receive and support a golf ball from a supply source, and provided at its other end with a weight sensitive transducer whereby, from a neutral start position, the tee is initially pivoted downwardly under the influence of the weight of a ball arriving at the tee, such initial movement being sensed by the transducer to activate control means causing the tee to be pivoted to an elevated, striking position, and loss of ball weight at the tee after striking of the ball also being sensed by the transducer to activate control means to cause the tee to be pivotally returned to its neutral position.

SUMMARY OF A SECOND ASPECT OF THE INVENTION

According to a second aspect of the invention there is provided a driving range tee incorporating a mechanical handing device for golf balls, in accordance with the first aspect

ADVANTAGES OF THE INVENTION

Although a typical golf ball is of relatively light weight, the lever arm serves to multiply the weight of a ball, when supported on the tee, to provide reliable sensing of the presence, or absence of a ball on the tee, and hence the activation mode required of the control means.

PREFERRED OR OPTIONAL FEATURES

The tee comprises a tubular member.

The tubular member is of rubber or synthetic plastics material.

The tubular member is provided with a flared mouth on which a portion of the periphery of a golf ball is adapted to seat so as to be supported.

Means are provided for automatically delivering individual balls to the tee, so that it is not necessary for the golfer to bend over to manually place a ball on the tee, so that the golfer does not loose stance or grip between shots thereby allowing small changes to be made in order to try improvements, whilst furthermore, the sequence of operation can be such that the next ball is being teed up whilst the current ball is being observed, resulting in less time being taken to drive a quantity of balls and, therefore, increasing the capacity of the driving range.

The ball delivery means delivers individual balls dynamically by a rolling action to the tee, and a stop means for the balls is provided in the vicinity of the tee.

The stop means is provided by one end of a linear groove, or depression, in a mat associated with the device.

The mat is provided with a through hole through which the tee is adapted to pass in accordance with the movement of the balance or lever arm and the tee, effected by the control means.

The transducer comprises an optical sensor and a calibrated spring.

The transducer comprises at least one micro-switch.

The automatic delivery means is disposed at an elevated location with respect to the tee, adapted to house a plurality of golf balls, and to separate, and dispense individual golf balls under control of the control means, from a discharge orifice.

The automatic delivery means comprises a ball platform located beneath a reservoir and a power driven rotary ball indexing plate provided with a plurality of circular holes of diameter greater than a golf ball, with the plate being indexed to a position in which an aperture finds itself above an inlet end of the chute, with sensor means to control release of a ball.

The sensor means is a spring.

The sensor means is an opto-electric sensor.

The automatic delivery means comprises a cam track.

The control means comprises an optical encoder.

The control means comprises a printed circuit board.

Rotation of the indexing plate is by a DC or a pneumatic motor.

The reservoir is of capacity to contain eg <100 golf balls.

The reservoir also houses, above the carousel, a shelf with a segment removed to from an escapement to control the entry of the balls into and out of the carousel pockets.

A motor drives a gearbox with the vertically mounted output shaft coupled to a ball carousel with multiple eg 8 ball pockets mounted inside the hopper.

A chute or similar device, has an inlet end located adjacent the discharge orifice of the delivery means and a lower delivery end, whereby a rolling ball exits from the delivery end.

The chute is arcuate, or generally so, so that its upper, inlet end may receive a golf ball in a vertical direction, and its discharge end may discharge a ball in a horizontal direction eg into the linear groove of a mat.

The chute comprises four parallel wire elements of suitable curvature. It follows that the extent of elevation of the automatic delivery means with respect to the tee must be such as to give a sufficient, but not excessive, rolling impetus to a ball such that the ball reaches the stop but does not have a momentum to pass beyond the stop.

As an alternative to a grooved mat, there may be provided a pair of flaps hinged on parallel axis, with, in the elevated position ends of the parallel edges of the flaps located adjacent the discharge end of the chute, with the flap edges serving as a rolling ball guide track.

The flaps are hingeable by a meshing finger arrangement, geared together.

In the alternative arrangement, the stop means is constituted by a stop surface provided on one or both flaps or fingers.

The motor for the indexing plate also drives any flaps or fingers between their upper ball conveying position and their lower position via lever arms and torsion rods.

A base of the machine provides a mount for the flaps or fingers which are hinged about parallel, horizontal axes.

The upper surfaces of the flaps or fingers are covered with a synthetic plastics simulating turf.

The flaps or fingers are spring loaded upwardly by a crank mounted on a horizontal input shaft.

The flaps or fingers are rotatable against the spring bias by a linkage.

The device has a start switch which, when actuated, causes the carousel to rotate ⅛ of a revolution to drop one ball down the wire chute whilst at the same time.

In the flap or finger embodiment detection means is provided to detect the ball in position over the tee eg by slight movement of the tee actuating an electrical switch. Alternatively, an electrical switch is mounted on one of the flaps or fingers which will allow the device to place balls on shorter tees or no tee at all. When the ball is detected over the tee, the motor starts to rotate again, causing the flaps or fingers to close which results in the ball being left upon the tee. When the flaps or fingers have fully closed the motor stops and the machine waits for the ball to leave the tee. As soon as the ball leaves the tee, the tee arm lifts and the cycle is repeated automatically.

The invention will now be described in greater detail, by way of examples, with reference to the accompanying drawings, in which.

Figure 3:
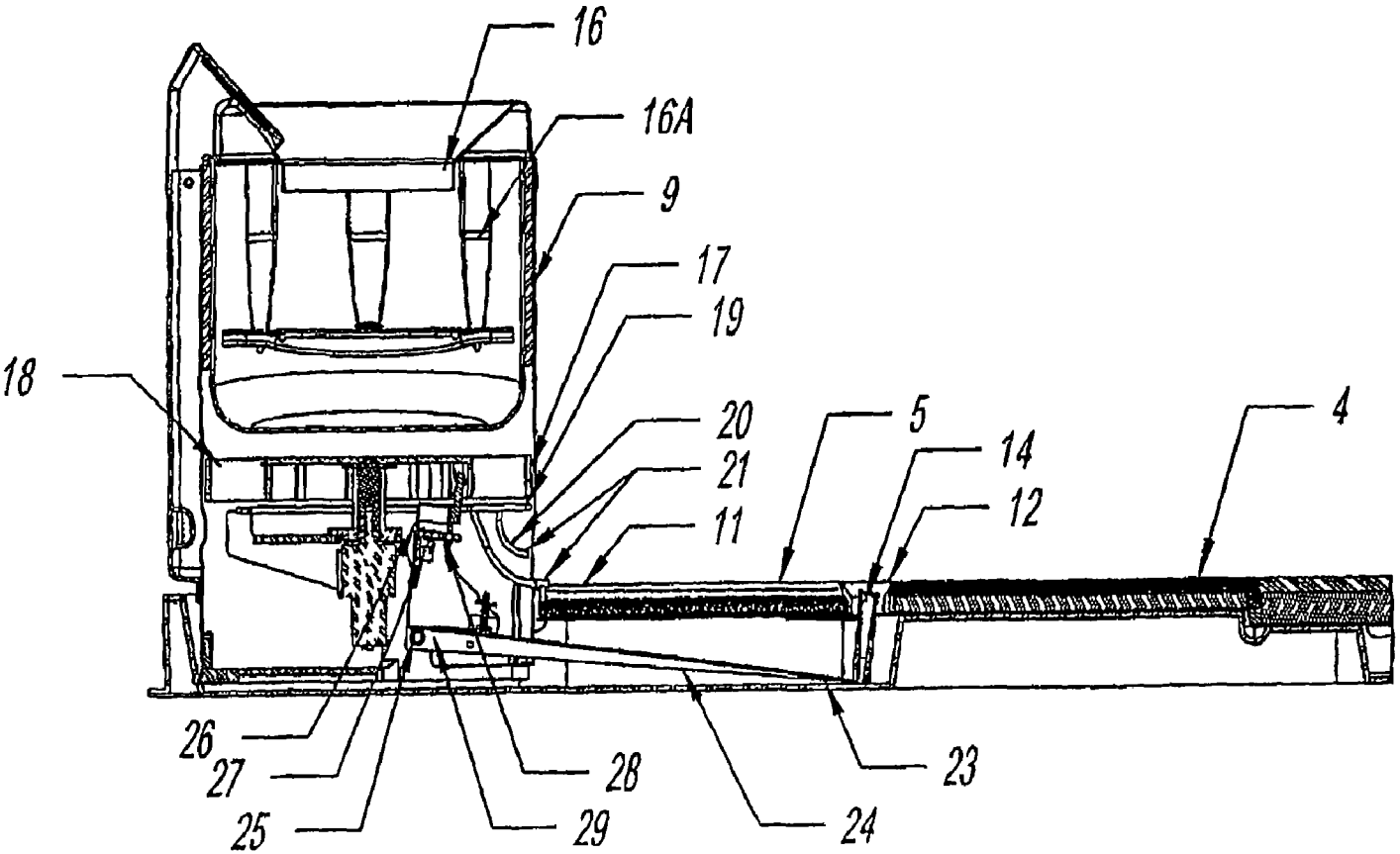
FIG. 3 is a section through FIG. 2 with the balance or lever arm in a neutral position.
Figure 4:
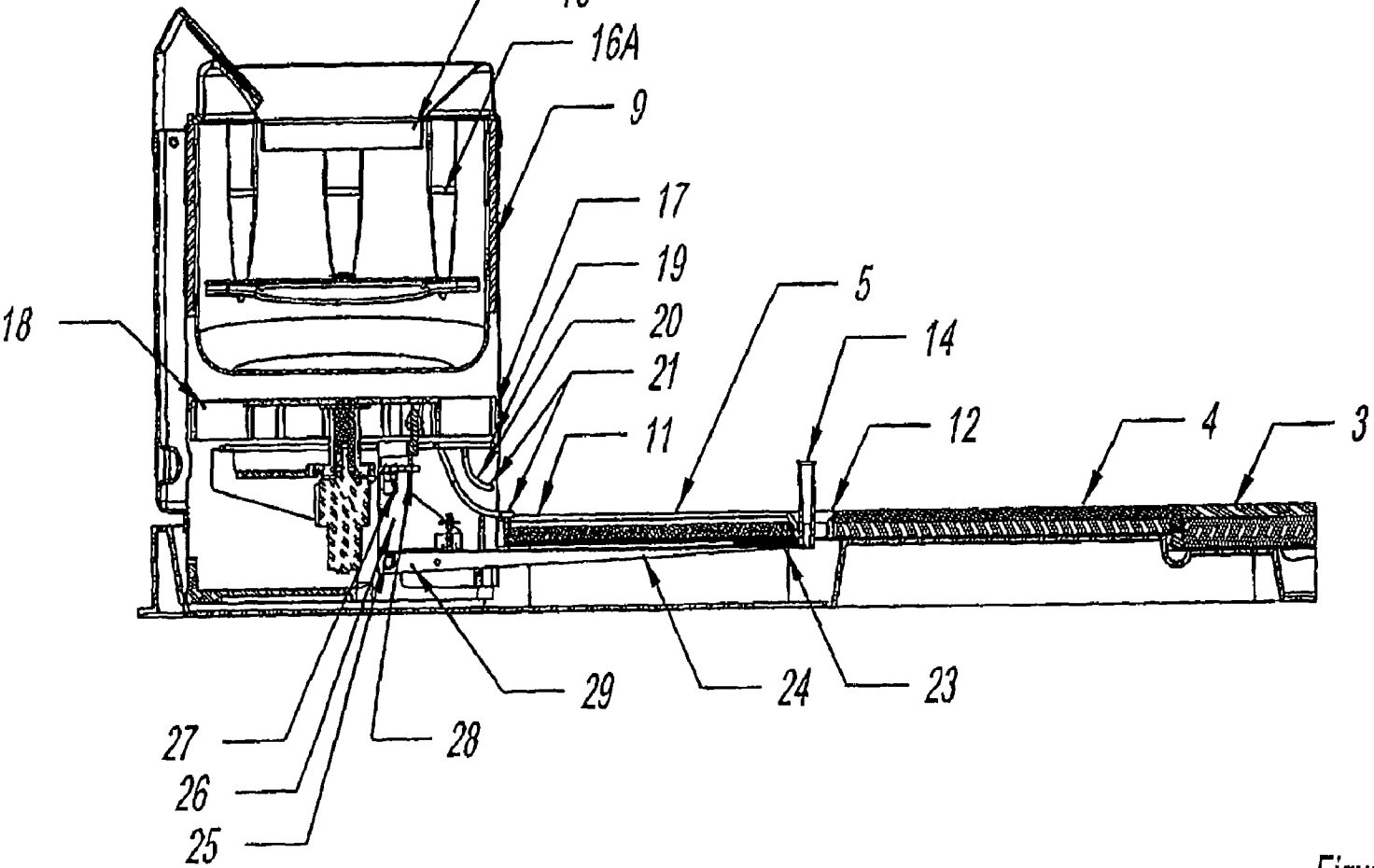
Figure 5:
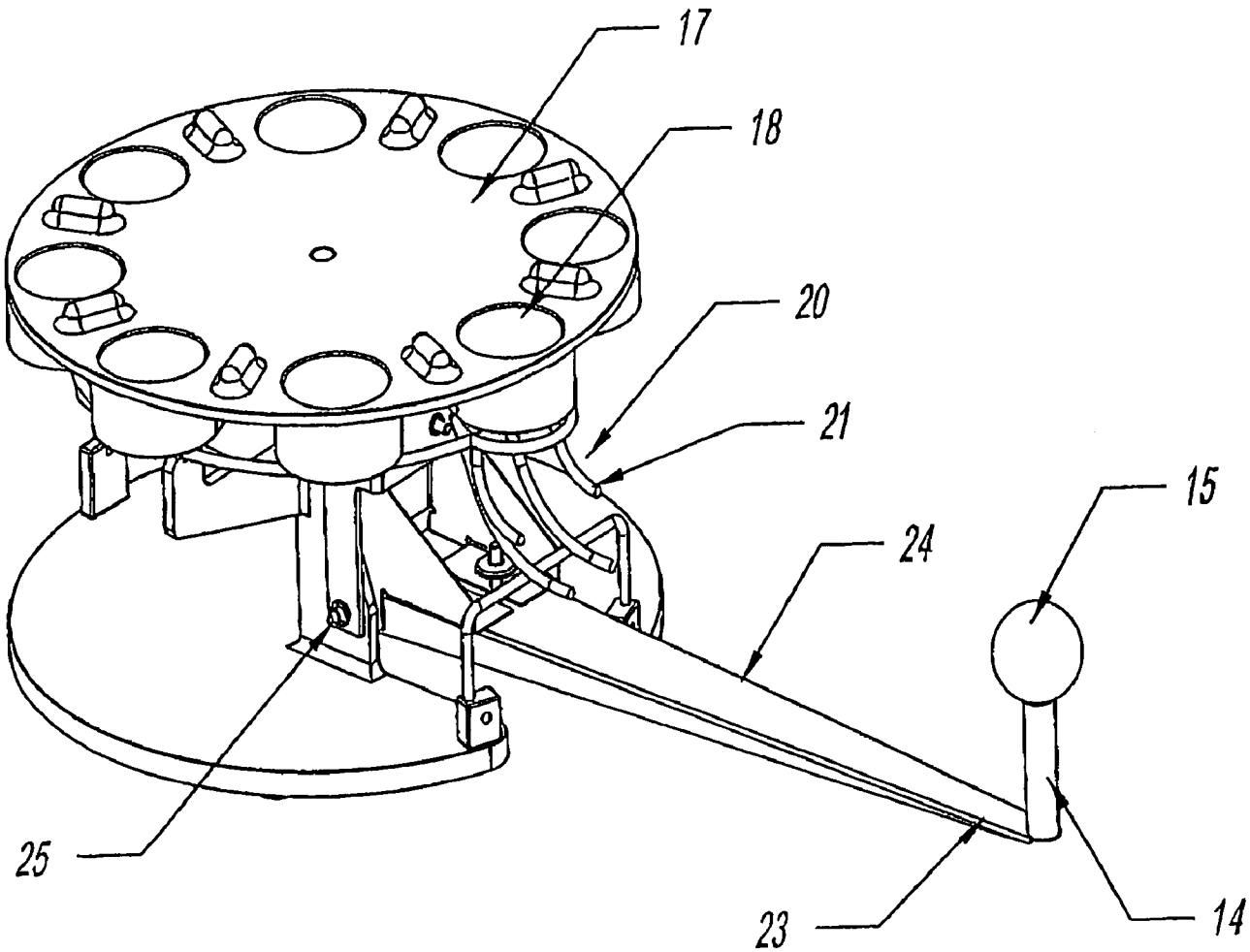
Figure 6:
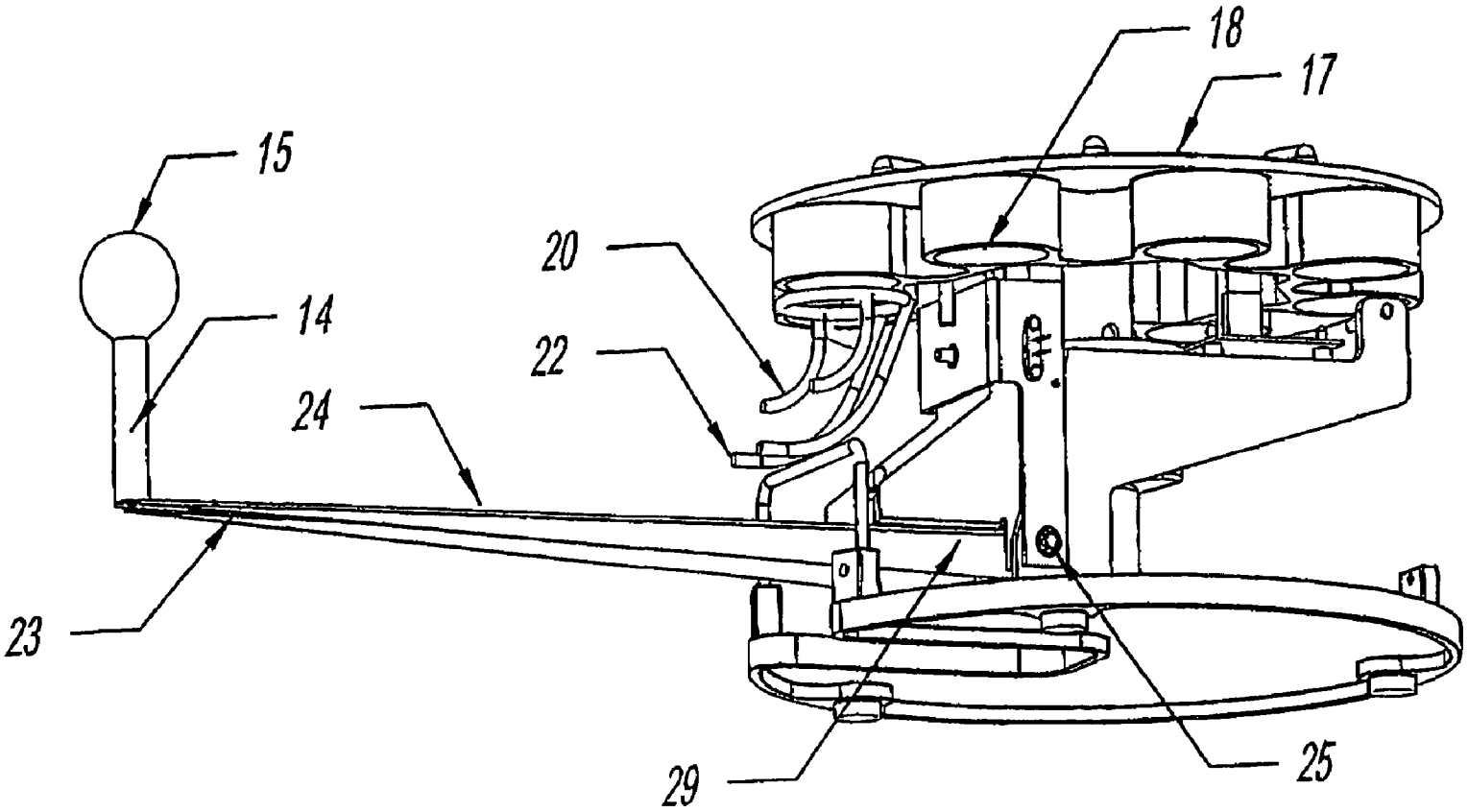
Figure 7:
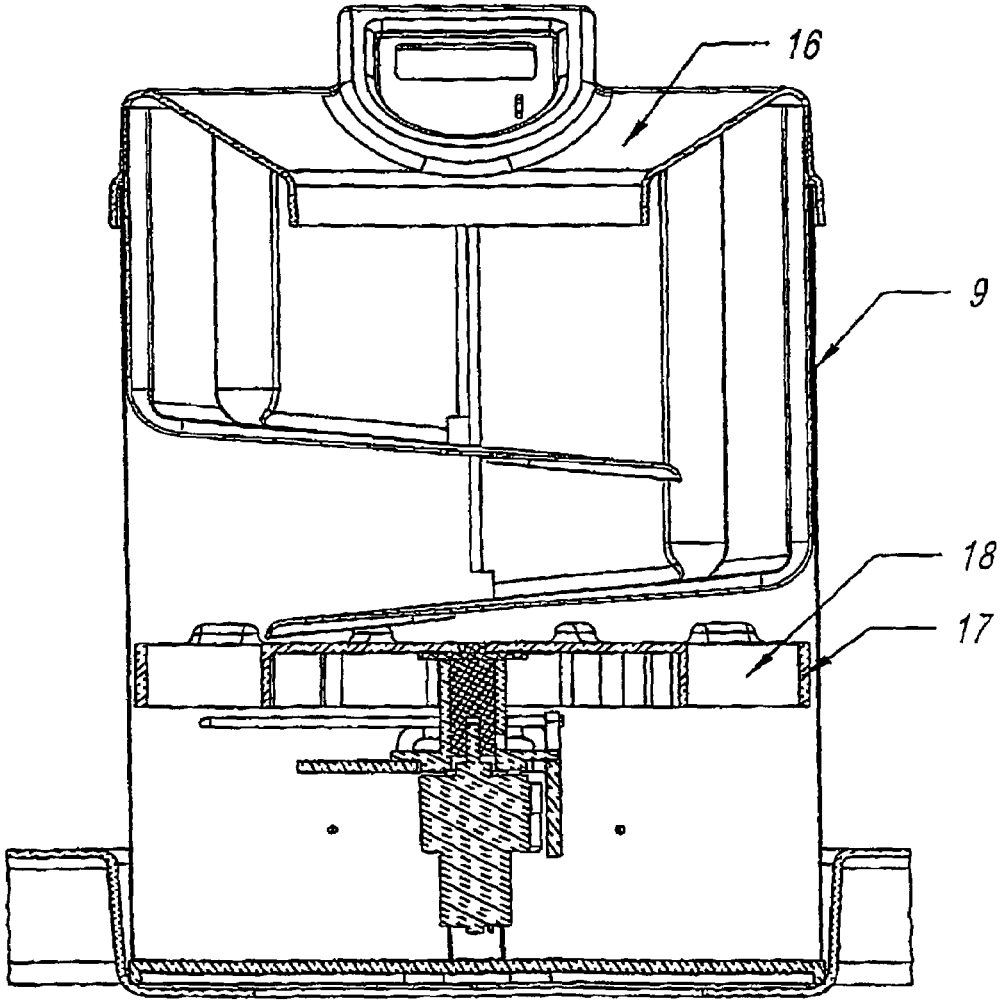

FIG. 4 corresponds to FIG. 3 but shows arm in an upper position;

FIG. 5 is a perspective view from one side and above of the automatic delivery means of FIGS. 1–4;

FIG. 6 corresponds to FIG. 5 but is from the other side, and below;

FIG. 7 is an axial sectional view through the automatic delivery means, and

Figure 8:
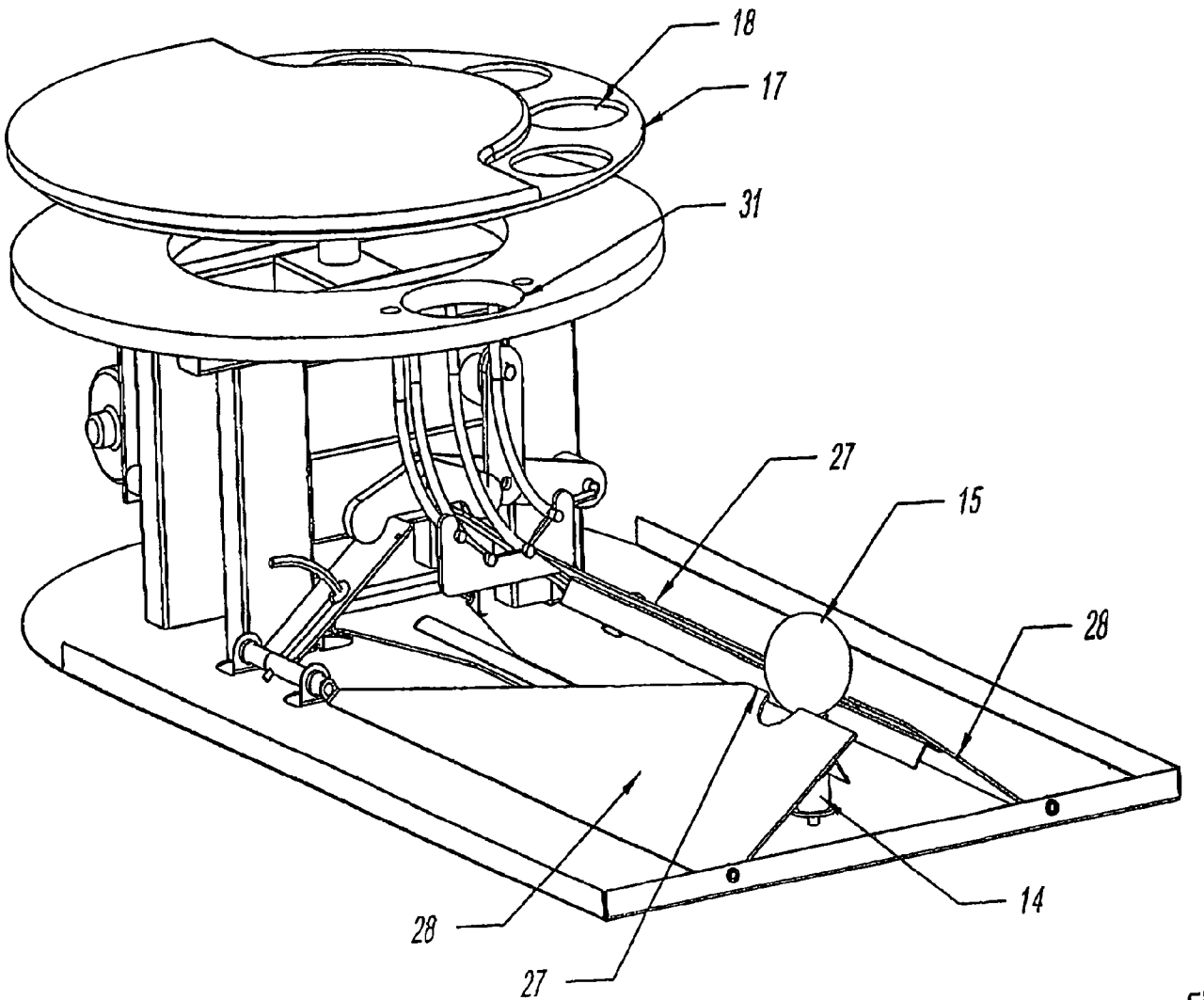
Figure 9:
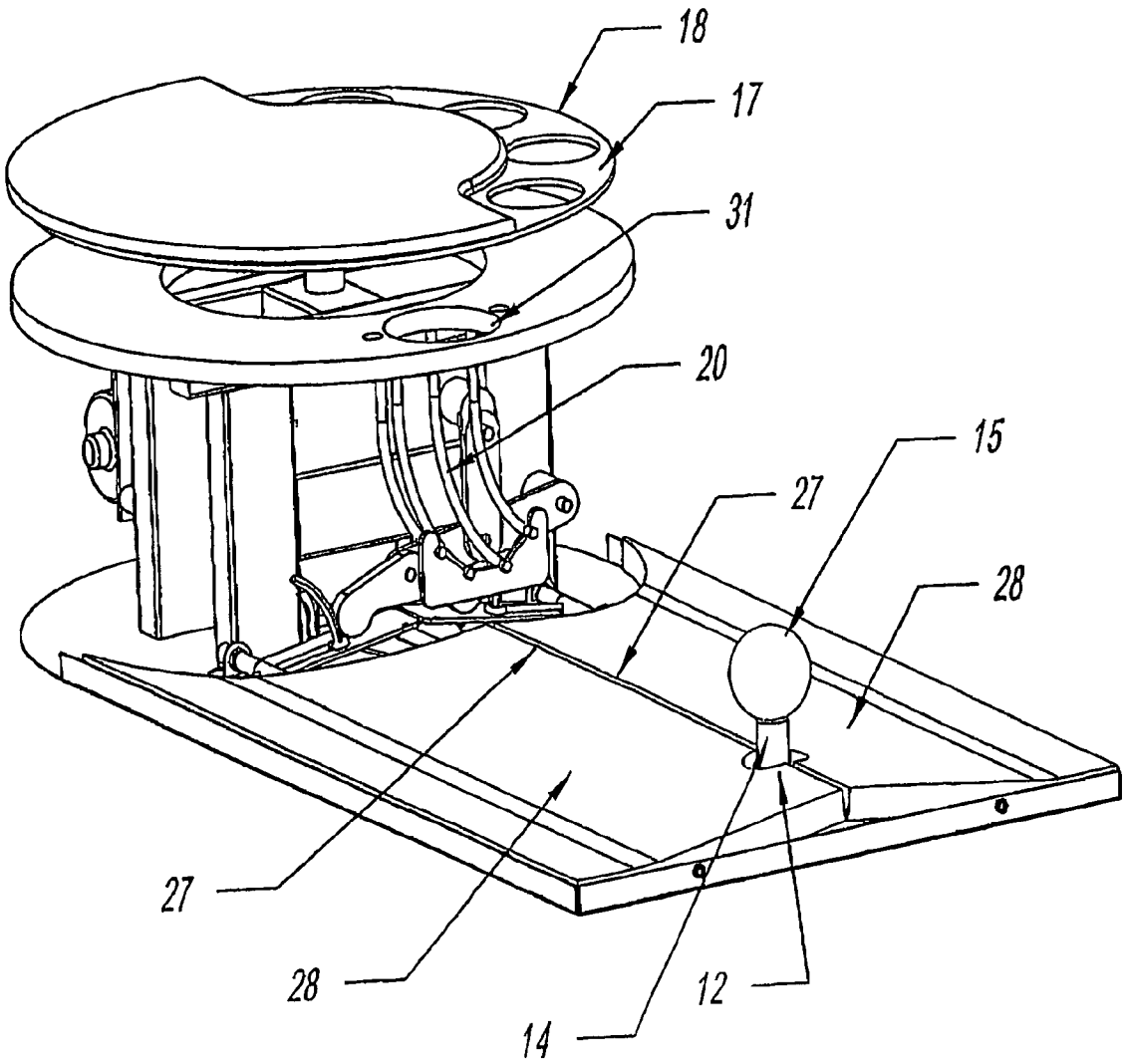

FIGS. 8 and 9 correspond to FIG. 5, but show a second embodiment of mechanical handling device, in two positions.

In both embodiments, like components are accorded like reference numerals.

Figure 1:
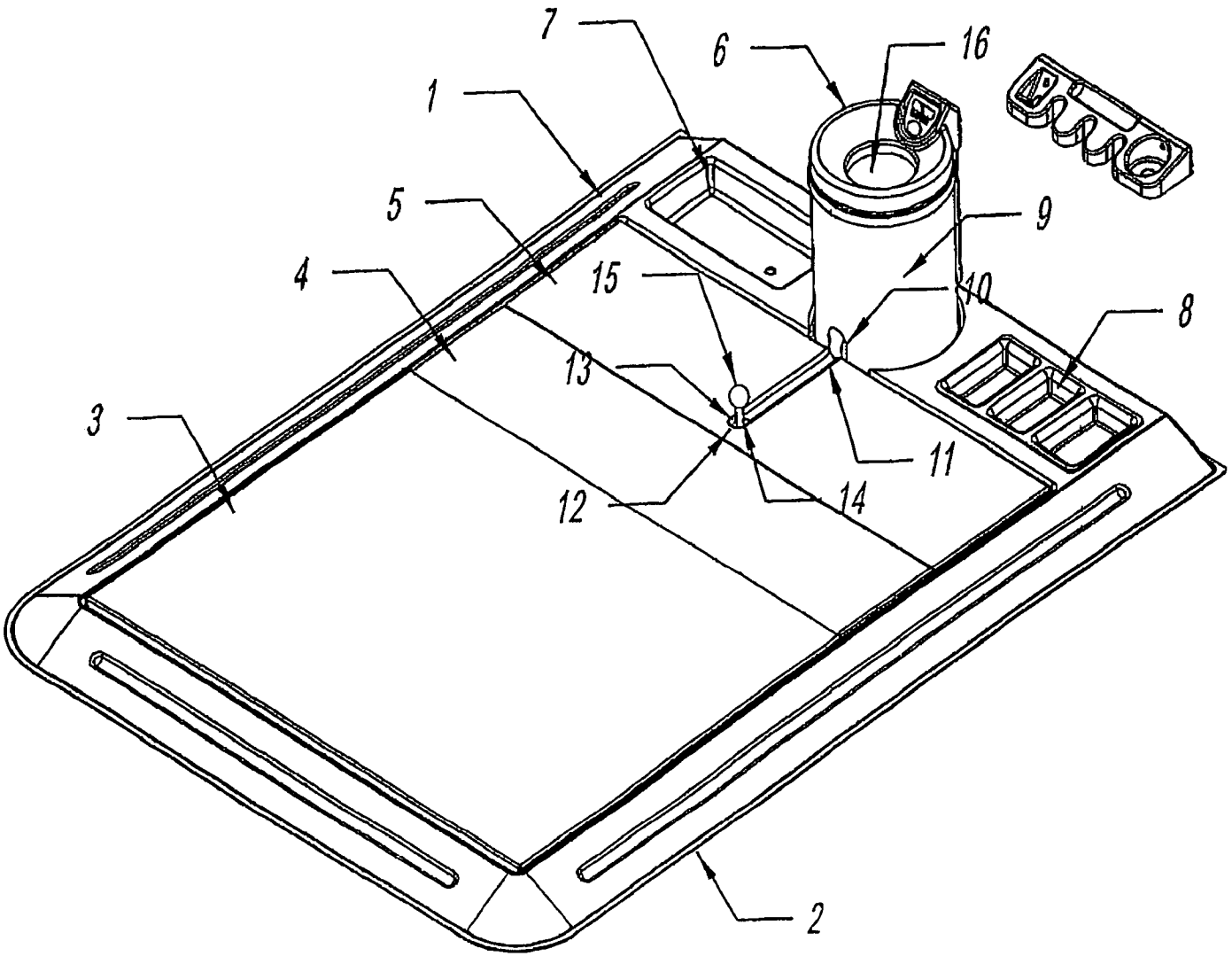
FIG. 1 is a perspective view of a driving range tee incorporating first embodiment of mechanical handling device in accordance with the invention.
Figure 2:
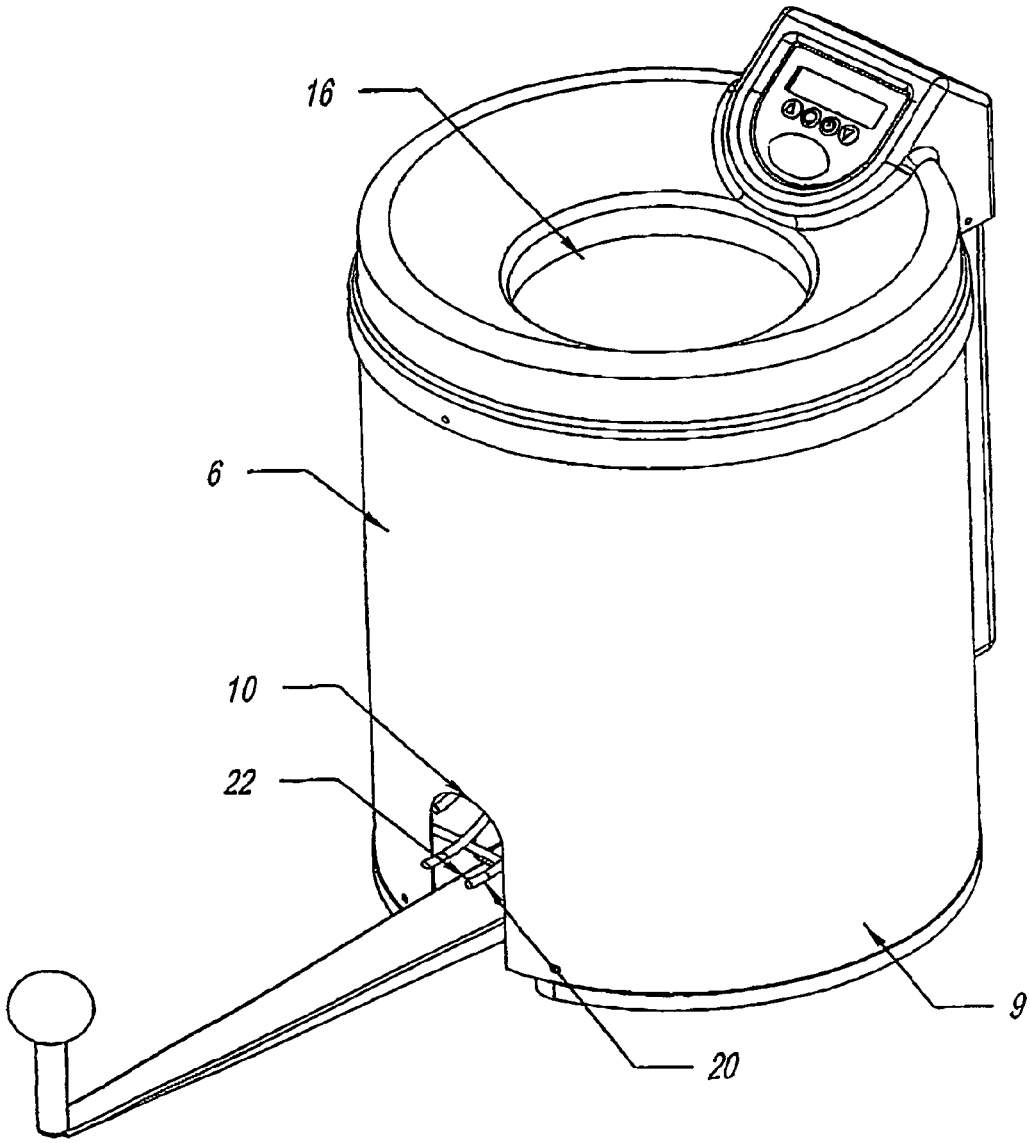
FIG. 2 is an enlargement of the mechanical handling device of FIG. 1.

In FIG. 1, a driving range tee 1 is defined by a rectangular tray 2 housing a standing mat 3, a driving mat 4 and a tee mat 5. Adjacent the tee mat 5 is a first embodiment of mechanical handling device 6 with, to each side of the device 6, storage areas 7 and 8.

The device 6 projects upwardly from the tee 1 to an elevated location and comprises a cylindrical outer casing 9 having a ball discharge orifice 10 at one end of a groove 11 in the tee mat 5, the other end of the groove 11 constituting a stop 12, where a circular aperture 13 is provided, through which a tubular tee 14 is movable, and adapted to support at its upper end a golf ball 15.

The device 6 has an inlet aperture 16 through which a plurality of balls 15 may be poured from a bucket or other container, into a hopper 16 beneath which, and co-axial with the outer casing 9, is an indexing plate 17 provided with a plurality of apertures 18 through which a golf ball 15 may pass. When an aperture 18 is above an upper inlet end 19 of a chute 20 constructed from four parallel wires 21, a ball may enter the chute and as due to the curvature of the chute, be given a rolling movement sufficient, upon exiting a discharge end 22 of the chute 20, to roll along the groove 11 until striking the stop 12 at which point the ball drops onto the upper end of the tubular tee 14.

The tubular tee 14 is supported on one end 23 of a lever or balance arm 24 of the device 6, the arm being pivotably mounted on a pin 25, while a transducer 26 comprising an optical sensor 27 and a calibrated spring 28, is associated with the other end 29 of the arm 24.

FIG. 3 shows a 'neutral' position of the arm 24, in which position the tubular tee 14 is about to receive a ball. Upon a ball engaging the tubular tee 14, the arrangement is such that the increase in weight causes the balance arm to fall (ie to rotate a few degrees clockwise) this rotation is sensed by the transducer 26, which through industry-standard control means (not shown) causes the arm 24 to be rotated anti-clockwise so as to elevate the ball 15, and the tubular tee 14, to the position indicated in FIG. 4.

When a ball 15 has been struck, the loss of weight at the end 23 of the arm 24 is again sensed by the transducer 26, to cause the arm 24 to be rotated a few degrees anticlockwise, to lower the tubular tee 14, from the 'striking' position of FIG. 4, to the striking 'neutral' position of FIG. 3, ready to receive the next ball.

In the second embodiment of FIGS. 8 and 9, the groove 11 of the first embodiment, is replaced by a pair of edges 27 of flaps 28 provided with a ball stop 12, the flaps being pivotably mounted on a tray 30 and displaceable between the elevated, ball receiver and conveying position of FIG. 8, and the striking position of FIG. 9, again with rolling momentum being provided by the chute 20. Also in this embodiment, a static plate having a ball escapement aperture 31 is located beneath the indexing plate 17.

What is claimed is:

1. A mechanical handling device for golf balls at a driving range, comprising a ball reservoir, a pivotally mounted balance or lever arm provided at one end with a tee, a ball striking surface located above the arm and having a ball delivery guide for delivering balls between the reservoir and the tee, said tee receiving and supporting a golf ball from a supply source, and provided at its other end with a weight sensitive transducer whereby, from a neutral start position, the tee is initially pivoted downwardly under the influence of the weight of a ball arriving at the tee, such initial movement being sensed by the transducer to activate control means for causing the tee to be pivoted to an elevated, striking position, and loss of ball weight at the tee after striking of the ball also being sensed by the transducer to activate control means for causing the tee to be pivotally returned to its neutral position.

2. A device as claimed in claim 1, wherein the tee comprises a tubular member.

3. A device as claimed in claim 2, wherein the tubular member is of rubber or synthetic plastics material.

4. A device as claimed in claim 2, wherein the tubular member is provided with a flared mouth on which a portion of the periphery of a golf ball seats so as to be supported.

5. A device as claimed in claim 1, wherein means are provided for automatically delivering individual balls to the tee.

6. A device as claimed in claim 5, wherein the ball delivery means delivers individual balls dynamically by a rolling action to the tee, and a stop means for the balls is provided in the vicinity of the tee.

7. A mechanical handling device for golf balls at a driving range, comprising a pivotally mounted balance or lever arm provided at one end with a tee to receive and support a golf ball from a supply source, and provided at its other end with a weight sensitive transducer whereby, from a neutral start position, the tee is initially pivoted downwardly under the influence of the weight of a ball arriving at the tee, such initial movement being sensed by the transducer to activate control means for causing the tee to be pivoted to an elevated, striking position, and loss of ball weight at the tee after striking of the ball also being sensed by the transducer to activate control means for causing the tee to be pivotally returned to its neutral position, means for automatically delivering individual balls to the tee, the ball delivery means delivering individual balls dynamically by a rolling action to the tee, a stop means for the balls provided in the vicinity of the tee, and wherein the stop means is provided by one end of a linear groove, or depression, in a mat associated with the device.

8. A device as claimed in claim 7, wherein the mat is provided with a through hole through which the tee passes in accordance with the movement of the balance or lever arm and the tee, effected by the control means.

9. A device as claimed in claim 1, wherein the transducer comprises an optical sensor and a calibrated spring.

10. A device as claimed in claim 1, wherein the transducer comprises at least one micro-switch.

11. A device as claimed in claim 5, wherein the automatic delivery means includes the ball reservoir, said reservoir is adapted to house a plurality of golf balls, and said automatic delivery means is disposed at an elevated location with respect to the tee, and to separate, and dispense individual golf balls under control of the control means, from a discharge orifice.

12. A device as claimed in claim 5, wherein the automatic delivery means comprises a ball platform located beneath the reservoir and a power driven rotary ball indexing plate provided with a plurality of circular holes of diameter greater than a golf ball.

13. A device as claimed in claim 5, wherein a chute has an inlet end located adjacent a discharge orifice of the automatic delivery means and a lower delivery end, whereby a rolling ball exits from the delivery end to the ball delivery guide.

14. A device as claimed in claim 13, wherein the chute is arcuate so that its upper, inlet end may receive a golf ball in a vertical direction, and its discharge end may discharge a ball in a horizontal direction.

15. A device as claimed in claim 13, wherein the chute comprises four parallel wire elements of suitable curvature.

16. A mechanical handling device for golf balls at a driving range, comprising a pivotally mounted balance or lever arm provided at one end with a tee to receive and support a golf ball from a supply source, and provided at its other end with a weight sensitive transducer whereby, from a neutral start position, the tee is initially pivoted downwardly under the influence of the weight of a ball arriving at the tee, such initial movement being sensed by the transducer to activate control means for causing the tee to be pivoted to an elevated, striking position, and loss of ball weight at the tee after striking of the ball also being sensed by the transducer to activate control means for causing the tee to be pivotally returned to its neutral position, a pair of flaps hinged on a parallel axis, with, in the elevated position, ends of parallel edges of the flaps located adjacent a discharge end of a chute, with the flap edges serving as a rolling ball guide track.

17. A device as claimed in claim 16, wherein the flaps are hingeable by a meshing finger arrangement, geared together.

18. A device as claimed in claim 17, wherein at least one of the upper surfaces of the flaps and fingers are covered with a synthetic plastics simulating turf, said turf defining a ball striking surface.

19. A device as claimed in claim 17, wherein at least one of the flaps and fingers are spring loaded upwardly by a crank mounted on a horizontal input shaft.

20. A driving range tee provided with a mechanical handling device, as claimed in claim 1.

21. A device as claimed in claim 6, wherein the ball striking surface comprises a mat associated with the device and the stop means is provided by one end of a linear groove, or depression, in the mat.

22. A device as claimed in claim 1, wherein the ball delivery guide comprises a pair of flaps hinged on a parallel axis, with, in the elevated position, ends of the parallel edges of the flaps located adjacent the discharge end of the chute, with the flap edges serving as a rolling ball guide track.

* * * * *